United States Patent [19]

Mirabel

[11] Patent Number: 4,819,828

[45] Date of Patent: Apr. 11, 1989

[54] IMPROVEMENTS IN BOXES HAVING ARTICULATED LIDS

[75] Inventor: Bruno Mirabel, Aubenas, France

[73] Assignee: Vincent-Jouret S.A., Aubenas, France

[21] Appl. No.: 101,197

[22] Filed: Sep. 25, 1987

[30] Foreign Application Priority Data

Oct. 1, 1986 [FR] France ..... 86 13905

[51] Int. Cl.[4] ..... B65D 43/14; B65D 51/00

[52] U.S. Cl. ..... 220/338; 220/337

[58] Field of Search ..... 220/334, 337, 338, 340, 220/341

[56] References Cited

U.S. PATENT DOCUMENTS

| | | | |
|---|---|---|---|
| 2,765,949 | 10/1956 | Hillman | 220/338 |
| 3,984,028 | 10/1976 | Zinnbauer | 220/338 |
| 4,209,090 | 6/1980 | Klein | 220/338 X |
| 4,211,337 | 7/1980 | Weavers et al. | 220/341 |

*Primary Examiner*—Stephen Marcus
*Assistant Examiner*—Nova Stucker
*Attorney, Agent, or Firm*—Dowell & Dowell

[57] ABSTRACT

A structure for mounting an articulated lid to a thermoformed box wherein the box includes outwardly projecting lugs which extend from the lateral or side walls of the box upon which are mounted or formed lateral bosses which are receivable within openings formed in the side walls of the lid when the projecting lugs are folded into vertically abutting relationship with the lateral walls of the box.

8 Claims, 4 Drawing Sheets

IMPROVEMENTS IN BOXES HAVING ARTICULATED LIDS

BACKGROUND OF THE INVENTION

1. Field of the Invention

The present invention relates to cases or the like in which the lid is articulated laterally on the sides of a box obtained by assembling a thermoformed bottom and a base element.

2. History of the Related Art

It is known that, in the type of cases described above, the lid is generally articulated on the box by two rivets or like members which are introduced into perforations made in register in the lateral walls of the box and the lid. It will be readily understood that the placing of these rivets constitutes an additional operation which appreciably increases the cost price of the finished articles.

It has therefore been proposed to ensure articulation of the lid by elastically clipping lateral bosses projecting on the thermoformed bottom inside perforations made in the sides of the lid. Assembly is somewhat simplified, but nonetheless the formation of the lateral bosses most often involves taking back the boxes after thermoforming, with the result that the cost remains high.

It is these drawbacks that the present invention intends to overcome.

SUMMARY OF THE INVENTION

According to the invention, the lateral bosses for articulating are provided on projecting lugs integrally formed with the box and folded against the lateral walls thereof when the lid is assembled.

BRIEF DESCRIPTION OF THE DRAWING

The accompanying drawing, given by way of example, will displace the invention, the characteristics that it presents and the advantages that it may procure, to be more readily understood.

DESCRIPTION OF THE PREFERRED EMBODIMENT

Figure 1:
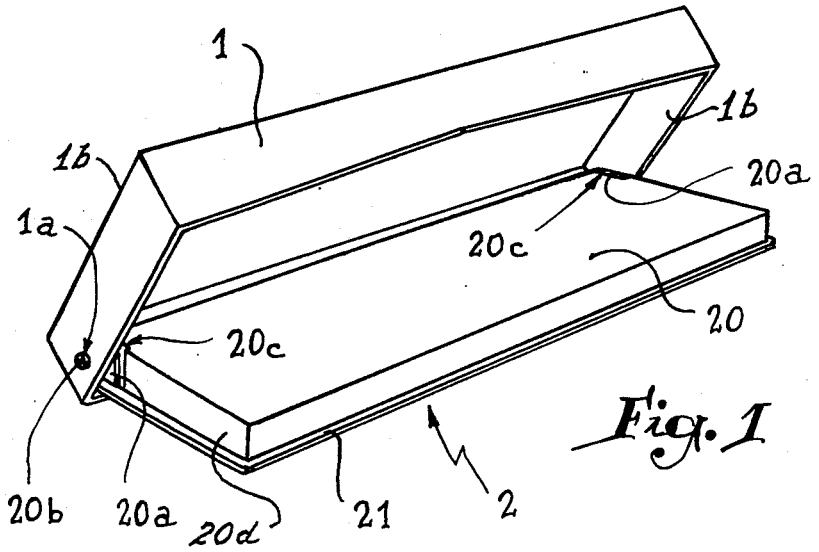
FIG. 1 is a view in perspective of a case made according to the invention.

The case shown in FIG. 1 essentially comprises a lid 1 of which the rear part articulates laterally on a box 2, which is made in manner known per se, by assembling (gluing or welding) a thermoformed bottom 20 and a base element 21.

Figure 2:
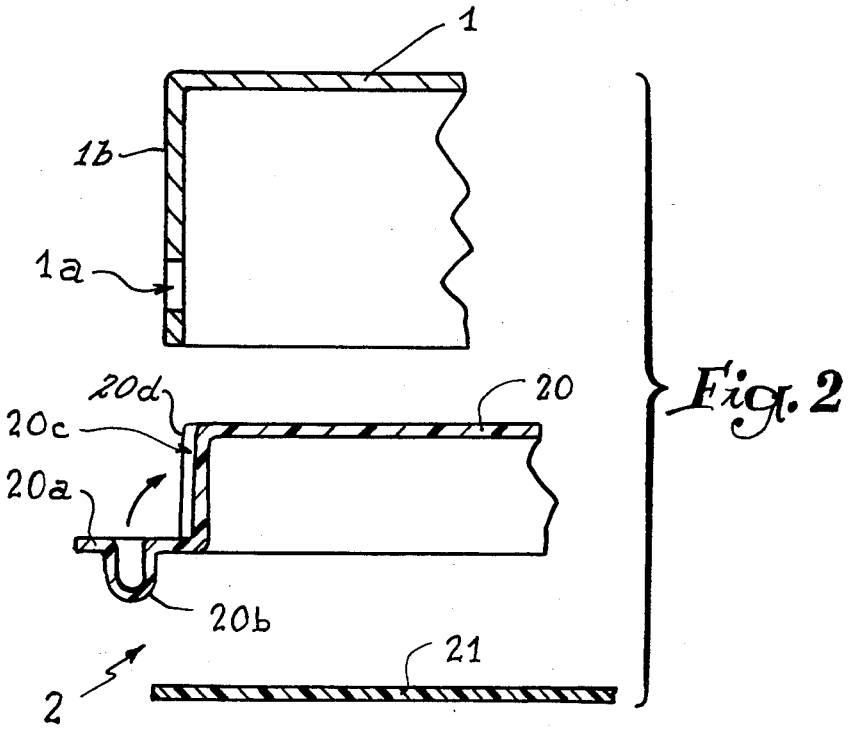
FIGS. 2 and 3 and 4 illustrate on a much enlarged scale the embodiment of this case.

As shown in FIG. 2, the thermoformed bottom 20 comprises on each of its lateral walls **20*d* a projecting lug 20*a* which, during the thermoforming operation, was stamped to present a boss 20*b* which projects downwardly. The two lugs 20*a* do not hinder in any manner assembly of the pieces 20 and 21, which assembly determines in conventional manner a lateral flange which is intended to serve as stop for the free edge of the lid 1**.

During assembly of this lid 1, it suffices that the operator raise the two lugs **20*a* and introduce, against a momentary elastic deformation, the bosses 20*b* in perforations 1*a* made in the lateral or side walls 16** of the lid

1. In this way, the articulated assembly shown in FIG. 4 is obtained.

It will be observed that, if care is taken to provide on each lateral wall **20*d* of the bottom 20, at the level of the projecting lug 20*a*, a recessed area such as the one referenced 20*c*, the upward folding of the lugs 20*a* does not determine any overthickness on the sides of the bottom 20**.

Figure 5:
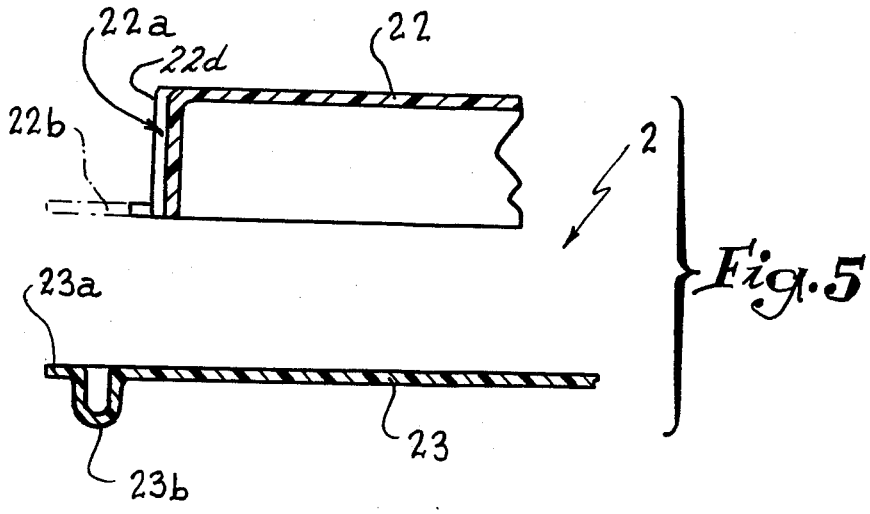
FIGS. 5 and 6, 7 and 8, respectively, are sections similar to those of FIGS. 2 and 4, but corresponding to two variant embodiments of the invention.
Figure 6:
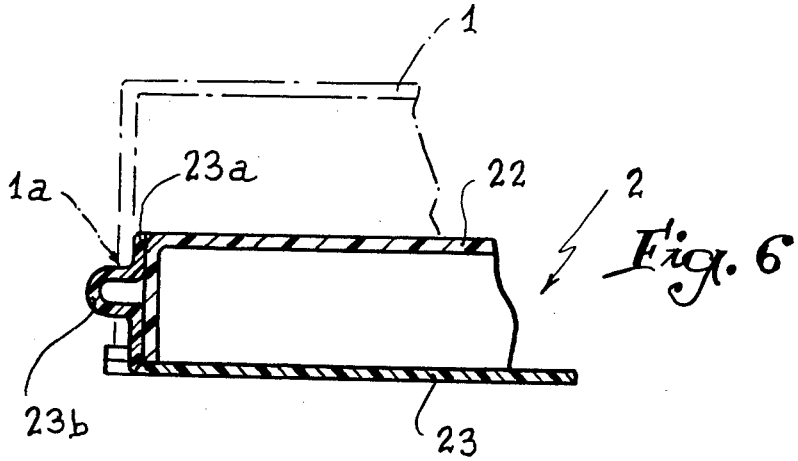

In the variant embodiment illustrated in FIGS. 5 and 6, it is the base, referenced 23, which laterally comprises two projecting lugs **23*a* of which each is provided with a boss 23*b* facing downwardly in the manner shown in FIG. 5. There again, after assembly of the bottom 22 and of the base 23, the two lugs 23*a* are folded vertically against the lateral walls 22d of the bottom 22 (these walls advantageously presenting recesses 22*a* to receive these lugs), with the result that the bosses 23*b*, then turned laterally, are capable of being introduced into the perforations 1*a* of the lid 1**.

Figure 3:
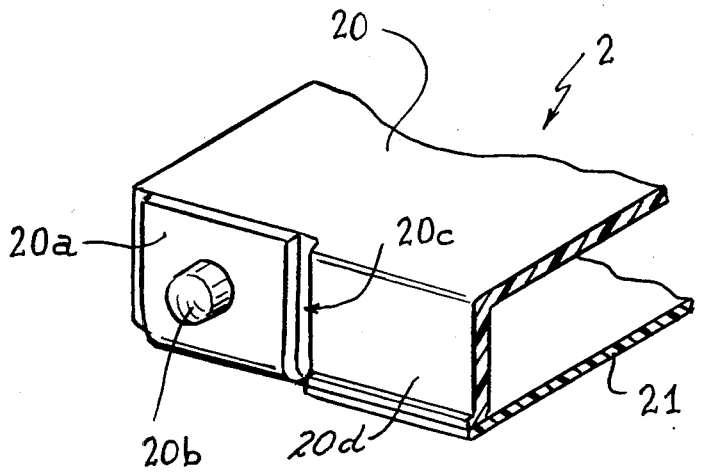
Figure 4:
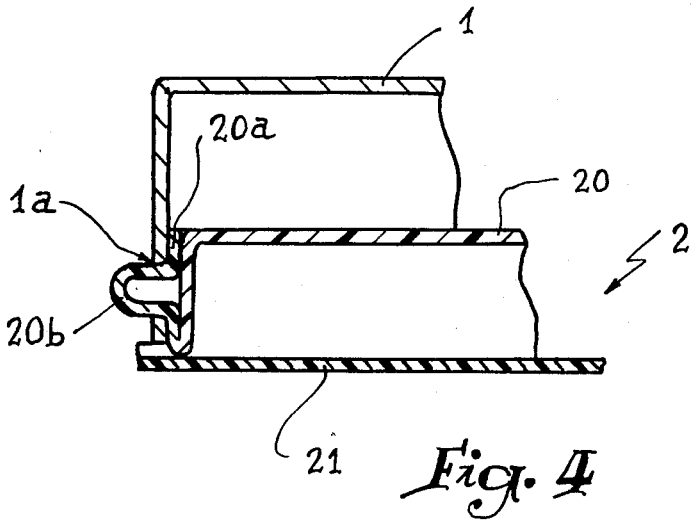
Figure 7:
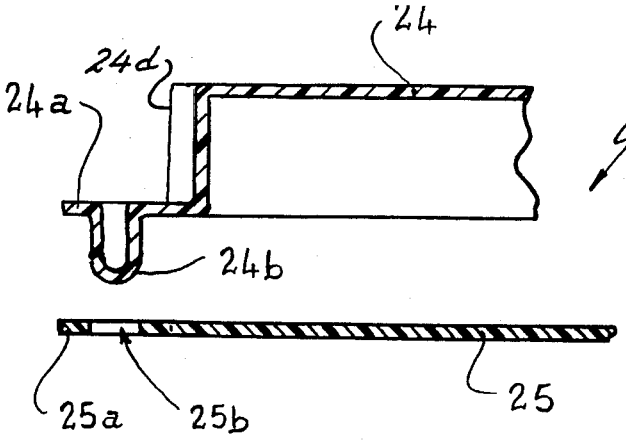
Figure 8:
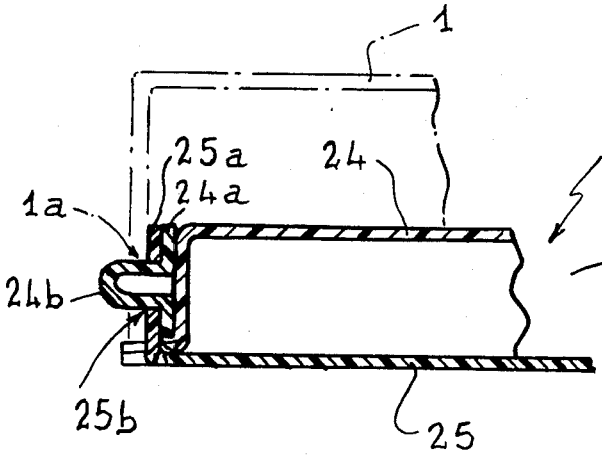

FIGS. 7 and 8 illustrate a third embodiment of the invention, wherein the projecting lugs, referenced **24*a* and provided with a downwardly turned boss 24*b*, are integrally formed and extend from side walls or lateral walls 24*d* the thermoformed bottom 24, as in the case of FIGS. 2 to 4. However, the base 25 comprises two equivalent projecting lugs 25*a* which are perforated at 25*b* and which, after introduction of the bosses 24*b* in the perforations 25*b*, are assembled with the lugs 24*a* during welding of the base 25 against the bottom 24. The double lugs 24*a*–25*a* thus obtained may be folded upwardly as illusrated in FIG. 8, so that the bosses 24*b* are engaged in the perforations 1*a* of the lid 1** to ensure articulated assembly thereof on the box.

It will be noted that the doubling thus made is capable of being adopted in the case of the embodiment according to FIGS. 5 and 6, the free edge of the bottom 22 being provided to this end with projecting lugs **22*b* which close the bosses 23*b* of the lugs 23*a* of the base 23**.

In any case, the mode of articulation obtained is particularly robust and reliable, for the whole use of the case.

It must, moreover, be understood that the foregoing description has been given only by way of example and that it in no way limits the domain of the invention which would not be exceeded by replacing the details of execution described by any other equivalents.

I claim:

1. In a case having a box which is selectively covered by a lid, the improvement comprising, said box having a bottom and base elements, said lid having side walls having an opening therein, said bottom element of said box having lateral walls, at least one of said bottom element and said base element having a projecting lug means extending outwardly from said lateral walls, said projecting lugs being foldable into abutment with said lateral walls of said bottom element, boss elements extending from each of said projecting lugs and extending outwardly of said lateral walls of said bottom element when said projecting lugs are abutting said lateral walls, and said boss elements being selectively receivable within said openings of said side walls of said lid to thereby pivotably assemble said lid to said box.

2. The case of claim 1 in which each of said projecting lug means is integrally formed with and extends from said bottom element of said box.

3. The case of claim 2 including second projecting lug means extending outwardly from said base element of said box, said second projecting lug means having an opening therein, said secod projecting lug means being vertically foldable so as to abut said lateral walls of said bottom element with said boss elements extending through said openings therein and said boss elements thereafter being extendable through said openings in said side walls of said lid.

4. The case of claim 3 in which said side walls of said bottom element include a recessed area, said projecting lug means being vertically foldable into said recessed area.

5. The case of claim 1 in which said projection lug means is integrally formed with said base element of said box.

6. The case of claim 5 including second projecting lug means extending outwardly from said bottom element of the box, said second projecting lug means having an opening therein, said second projecting lug means being foldable into vertical relationship with respect to said projecting lug means of said base element whereby said boss element of said projecting lug means may be selectively extended through said opening in said second projecting lug means.

7. The case of claim 6 including a recessed area in said bottom element adjacent said second projecting lug means, said projecting lug means being receivable within said recessed area in said lateral walls.

8. The case of claim 1 including a recess in said lateral walls of said bottom element of the box, said projecting lug means being receivable within said recesses when said projecting lug means is vertically folded with respect to said lateral walls.

* * * * *